US005380088A

United States Patent [19]

Fleischli et al.

[11] Patent Number: 5,380,088

[45] Date of Patent: Jan. 10, 1995

[54] MIXING DEVICE FOR SMALL FLUID QUANTITIES

[75] Inventors: Markus Fleischli, Zürich; Felix Streiff, Winterthur, both of Switzerland

[73] Assignee: Sulzer Brothers Limited, Winterthur, Switzerland

[21] Appl. No.: 183,926

[22] Filed: Jan. 21, 1994

Related U.S. Application Data

[63] Continuation of Ser. No. 887,717, May 22, 1992, abandoned.

[30] Foreign Application Priority Data

Jul. 30, 1991 [CH] Switzerland ..... 02275/91

[51] Int. Cl.[6] ..... B01F 5/04; B01F 5/06

[52] U.S. Cl. ..... 366/174; 366/162; 366/173; 366/337; 261/112.2

[58] Field of Search ..... 366/336, 337, 338, 340, 366/167, 173, 174, 177, 172, 134, 162, 101, 163; 261/112.2, 98, 76; 239/432

[56] References Cited

U.S. PATENT DOCUMENTS

| | | | |
|---|---|---|---|
| 1,419,216 | 6/1922 | Burckhardt | 99/515 |
| 1,637,697 | 8/1927 | Jacobsen | 366/336 |
| 3,018,182 | 1/1962 | Leach . | |
| 3,297,305 | 1/1967 | Walden | 366/101 |
| 3,643,927 | 2/1972 | Crouch | 366/337 |
| 3,785,620 | 1/1974 | Huber | 261/98 |
| 3,918,688 | 11/1975 | Huber et al. | 366/336 |
| 3,943,221 | 3/1976 | Schladitz | 261/98 |
| 4,040,256 | 8/1977 | Bosche et al. | 366/337 |
| 4,068,830 | 1/1978 | Gray | 366/340 |
| 4,266,879 | 5/1981 | McFall | 366/336 |
| 4,441,823 | 4/1984 | Power | 366/167 |
| 4,564,298 | 1/1986 | Gritters et al. | 366/167 |
| 4,573,803 | 3/1986 | Gritters . | |
| 4,674,888 | 1/1987 | Carlson . | |
| 4,731,229 | 3/1988 | Sperandio | 366/336 |
| 4,744,928 | 5/1988 | Meier | 366/337 |
| 4,824,614 | 4/1989 | Jones | 366/338 |
| 5,124,086 | 6/1992 | Schultz | 366/338 |

FOREIGN PATENT DOCUMENTS

| | | | |
|---|---|---|---|
| 0157569 | 10/1985 | European Pat. Off. . | |
| 0167060 | 1/1986 | European Pat. Off. . | |
| 2412454 | 7/1975 | Germany . | |
| 3140640 | 6/1982 | Germany | 261/112.2 |
| 291049 | 9/1953 | Switzerland . | |
| 581493 | 11/1976 | Switzerland | 366/167 |

*Primary Examiner*—David A. Scherbel
*Assistant Examiner*—Tony G. Soohoo
*Attorney, Agent, or Firm*—Townsend and Townsend Khourie and Crew

[57] ABSTRACT

The device for mixing a small quantity of fluid (1) into a the main flow of another fluid (2) in a main channel comprises an injection system (3) and a static mixing unit (4, 5) arranged downstream. The inlet cross section (F) of the mixing unit is divided into sub-areas (F1, F2, F3, F4). The injection system consists of main metering pipes with a plurality of directed metering openings (21). The flow quantities through the metering openings are proportional to the component flows through the corresponding associated sub-areas (F1, F2, F3, F4). This results in uniform thorough mixing over a short distance and with a small pressure drop. The mixing device is particularly suitable for Denox plant.

14 Claims, 6 Drawing Sheets

Figure 3A:
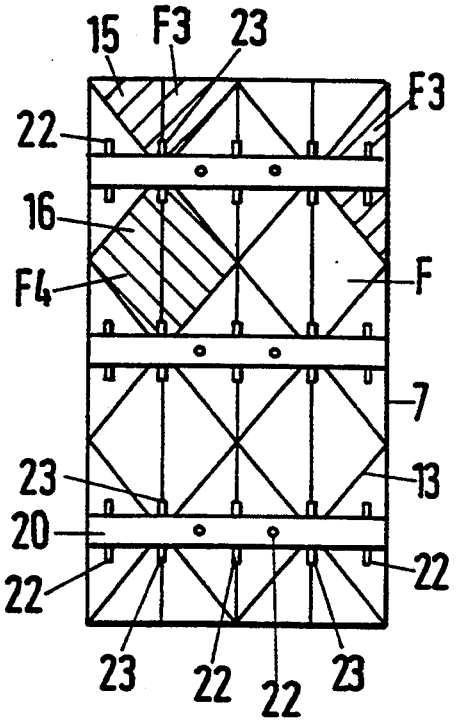

Fig.1a
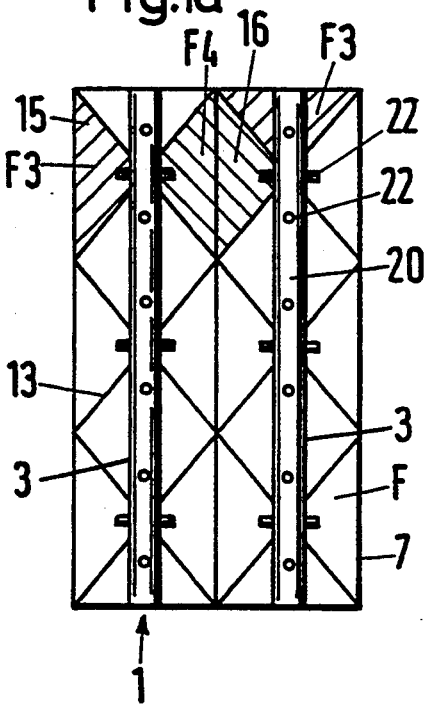
Fig.1b
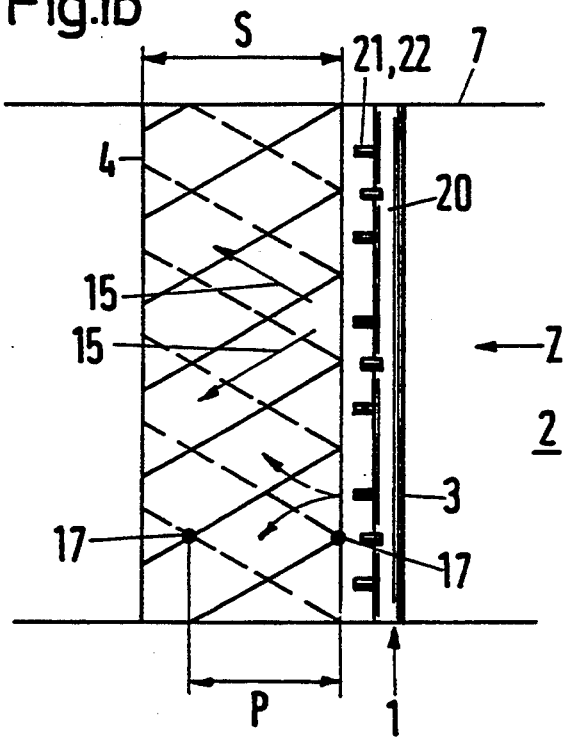
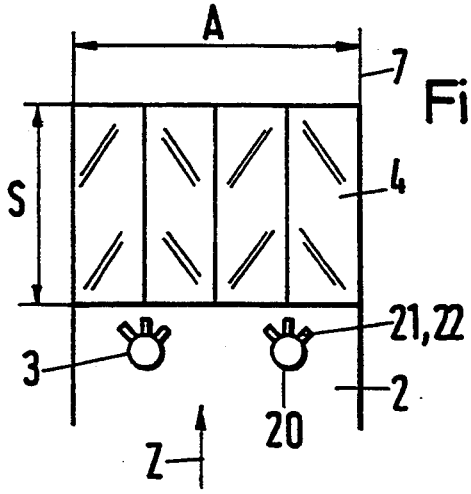
Fig.1c
Fig.1d
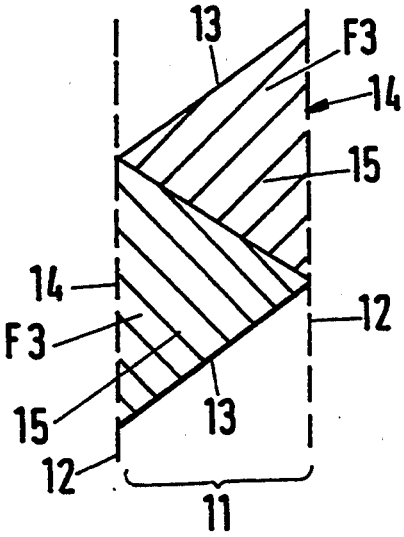

Fig.5a
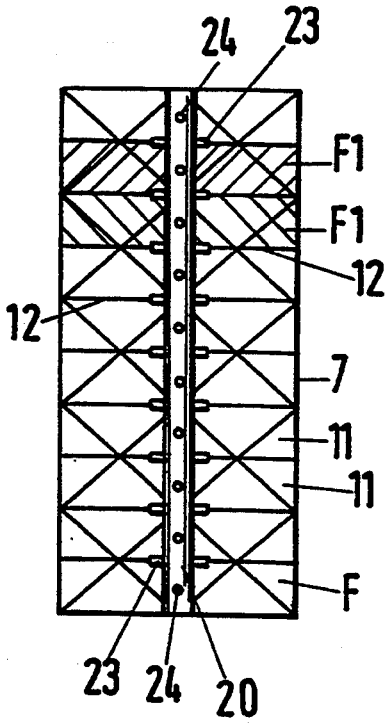
Fig.5b
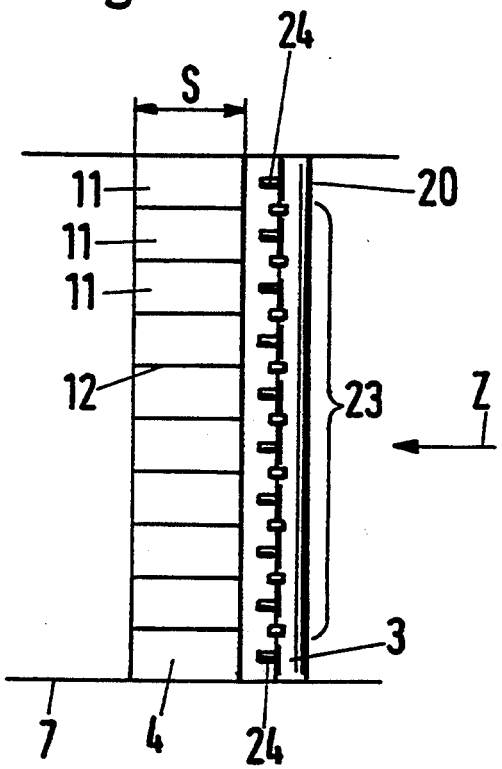
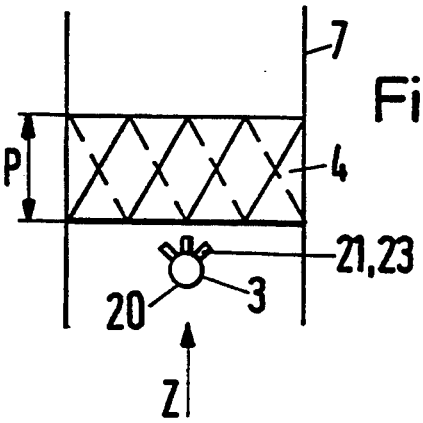
Fig.5c
Fig.4
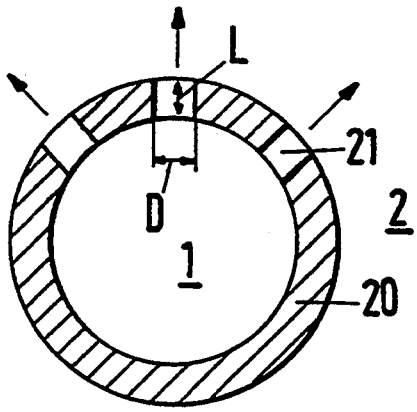

MIXING DEVICE FOR SMALL FLUID QUANTITIES

This is a continuation of application Ser. No. 07/887,717, filed May 22, 1992, now abandoned.

The invention relates to a device for mixing a small quantity of a fluid into a main flow of another fluid in a main channel, with an injection system and at least one static mixing unit arranged downstream. Very long mixing sections in the empty pipe are required when adding relatively small quantities of less than 10%, for example, of a gas or liquid to the flow of another gas or another liquid in order to obtain a homogeneous mixture. Intimate mixing can be forced over short sections by using static mixers, although this entails a greater pressure drop. However conventional mixing devices with complex adjustable injection systems or with simple injection systems and static mixers cannot meet high requirements regarding mixing efficiency in a wide load range or, in particular, in the case of very low volumetric flow ratios. In Denox plant, for example, denitrogenation is carried out by mixing gaseous ammonia into the waste-gas flow in a very low ratio of 1:1000 to 1:10000. In this case a very high degree of homogeneity must be achieved (with a maximum deviation of less than 5%, related to the mean value) so that on the one hand the neutralizing reaction can take place completely at all points in the subsequent catalyzer, in order to be able to maintain low nitric oxide limiting values, and on the other no excess ammonia can break through. The stoichiometric mixture ratios must therefore be satisfied uniformly and constantly over the entire channel cross section. This mixing efficiency must also be achieved over short sections and with a small pressure drop, requirements which known mixing devices do not satisfy.

The object of the invention is therefore to overcome these disadvantages and provide a simple mixing device which guarantees a high mixing efficiency over the entire channel cross section and in a wide load range, even over short sections and while maintaining a small pressure drop. This object is solved according to the invention by a mixing device according to claim 1. The dependent claims relate to advantageous arrangements and developments of the invention.

By dividing the inlet cross section of the mixing unit into sub-areas, which are defined by the mixer structure, on the one hand and associating the directed metering openings with these sub-areas on the other, a combined, particularly satisfactory homogenization effect is achieved if the flow quantities through the metering openings are adjusted proportionally to the component flows through the corresponding sub-areas. A particularly simple association enables the total cross-sectional area of the metering openings associated with each sub-area to be directly proportional to this sub-area. Very simple directed metering openings may be formed as cylindrical bores in the wall of the main metering pipe or as outlet pipes. The metering openings may advantageously be directed at the inside of the sub-channels. Particularly simple and inexpensive arrangements in the case of sub-areas defined by layers may have just one main metering pipe extending perpendicularly to the layer planes. In order to achieve uniform metering with all the metering openings of a main metering pipe, the cross section of the main metering pipe may be at least twice as great as the sum of the cross-sectional areas of its metering openings. The sub-channels of the mixing unit may preferably be disposed at an angle of between 25° and 35° with respect to the main flow direction to achieve the smallest possible pressure drops. Particularly intimate turbulent mixing may, however, be achieved with a larger angle of, for example, 45°.

The good homogenization results according to the invention can be achieved with very short mixing units, e.g. with a mixing unit which is between one and two times as long as the spacing of two adjacent intersection points of the mixing unit. Further mixing devices of a particularly high mixing efficiency, while maintaining a small pressure drop, may comprise after the first mixing unit a free post-mixing section in the main channel which is between two and six times as large as the spacing of adjacent intersection points of the mixing unit or between one and three times as large as the smallest diameter of the main channel. A second mixing unit may also be arranged subsequent to the post-mixing section. Furthermore, at least two mixing units whose sub-channels point in different directions may be arranged in the main channel. The devices according to the invention are also particularly suitable for mixing ammonia into the waste-gas flow of a denitrogenation plant.

Figure 2:
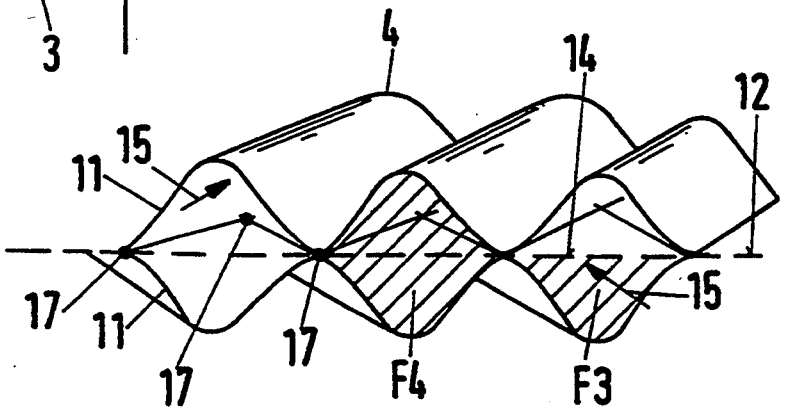
Figure 6A:
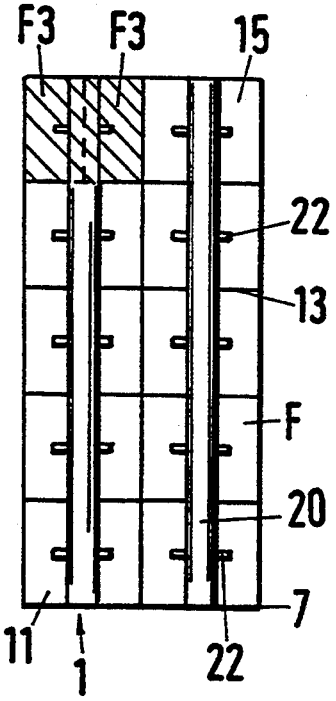
Figure 6B:
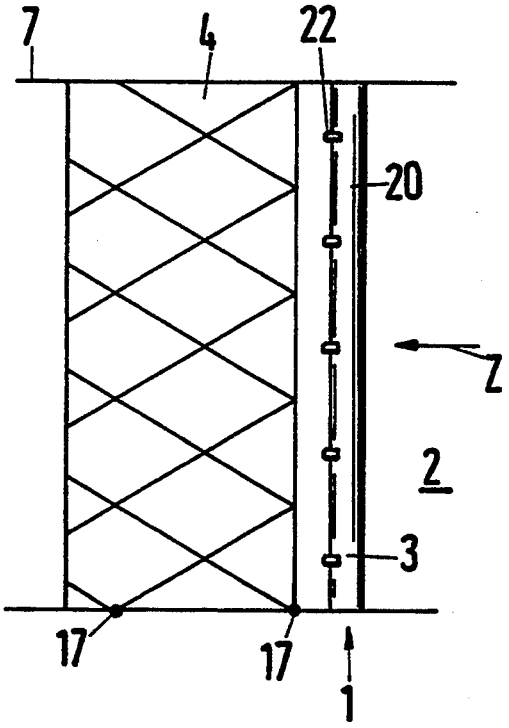
Figure 6C:
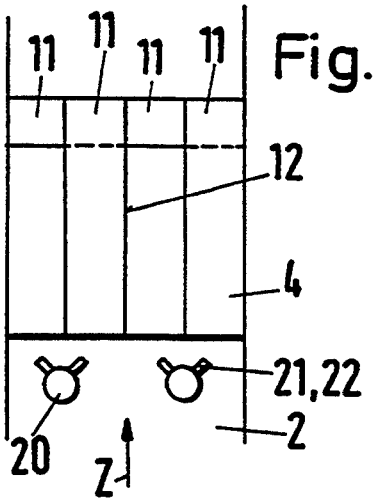
Figure 6D:
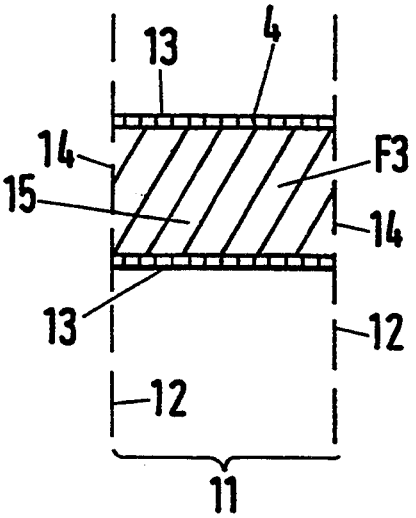
Figure 7A:
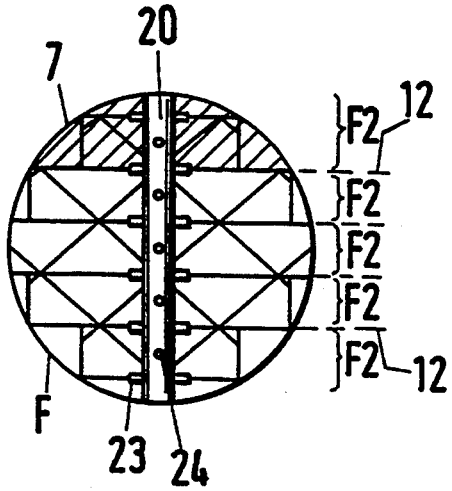
Figure 8:
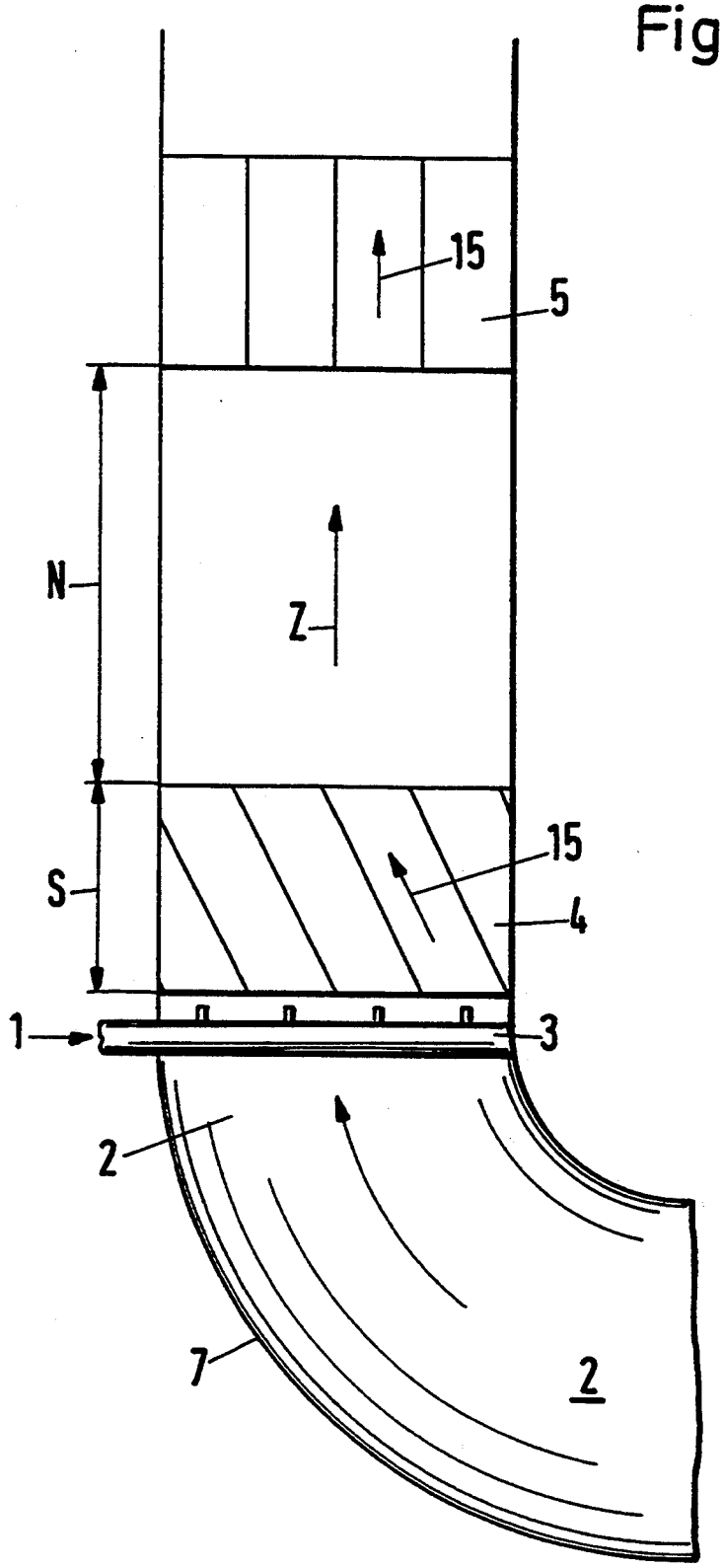

The invention is illustrated further in the following with reference to drawings, in which:

FIGS. 1*a, b, c* are three elevations of an example of a mixing device according to the invention;

FIG. 1*d* shows flow channels formed by V-shaped mixer layers;

FIG. 2 shows two layers of a static mixing unit with intersecting sub-channels;

FIGS. 3*a, b, c* show an example with three main pipes;

FIG. 4 shows directed metering openings as bores;

FIGS. 5*a, b, c* show an example with a main pipe and metering openings directed at the mixing unit layers as sub-areas;

FIGS. 6*a, b, c, d* show an example with web-like mixer layers and rectangular sub-channels;

FIGS. 7*a, b, c* show an example with a round main channel cross section;

FIG. 8 shows a mixing device with a post-mixing section and a second mixing unit arranged downstream.

FIG. 1 shows a mixing device according to the invention in three elevations with an injection system 3 for mixing a fluid 1 into another fluid 2 in a main channel 7 and a static mixing unit 4, which is arranged downstream in the main flow direction Z. As shown in FIG. 1*a*, the inlet cross section F is divided into sub-areas F3, F4, which are defined by the sub-channels 15, 16 formed by the mixing unit 4. One of these sub-channels 15 of a mixing unit consisting of V-shaped layers 11 (e.g. Sulzer SMV mixer) is shown in FIG. 1*d*. These layers form the two walls 13 of the sub-channel 15 with a cross-sectional area F3, while the boundary 14 is defined by the layer plane 12 at the open side. The arrangement of the layers 11 is shown in perspective in FIG. 2, in which two layers 11 of a corrugated mixer structure form intersecting sub-channels 15 with intersection points 17. F3 is the cross-sectional area of the inlet of a sub-channel 15 in a layer 11, corresponding to the edge channels in FIG. 1*a*. Each two inner sub-channels 15 of adjacent layers combine to form an inner sub-channel 16 with a double cross-sectional area $F4=2\times F3$ which is defined by the channel walls 13

Figure 3B:
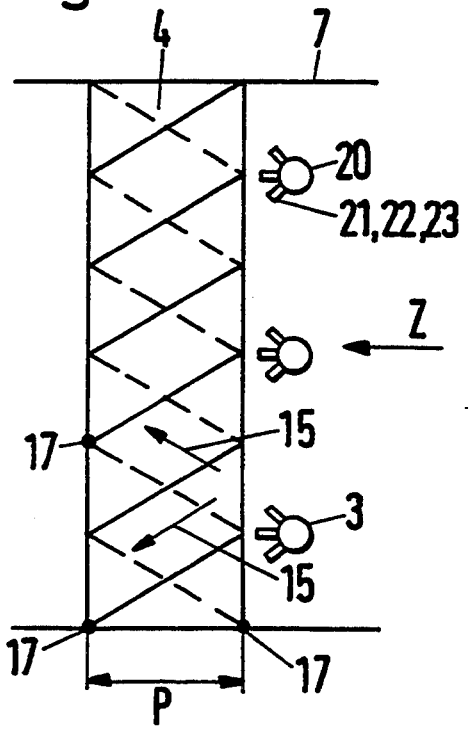
Figure 3C:
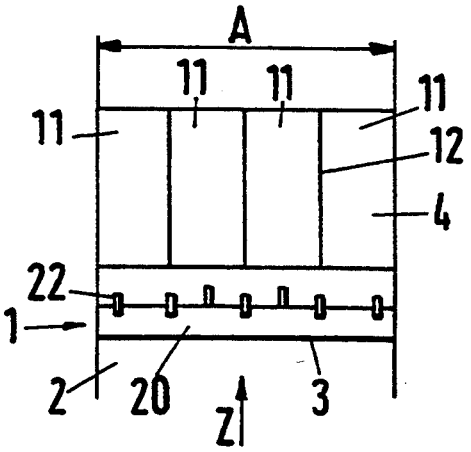

(see FIG. 1*a*). The mixing unit comprises four layers, which divide the inlet cross section F into ten sub-channels 15 at the edge with sub-areas F3 and into seven inner sub-channels 16 with sub-areas F4. The associated injection system 3 consists of two main metering pipes 20, which extend parallel to the layer planes 12, with metering openings 21 directed at the sub-areas F3, F4. The distribution and dimensioning of the metering openings are associated with the sub-areas such that the flow quantities through the metering openings are, as far as possible, proportional to the component flows of the main flow through the corresponding sub-areas. If the flow speed in the main channel 7 is uniform over the entire inlet cross section F, the flow quantity through the associated metering openings is adjusted so as to be proportional to the sub-areas. For the sake of simplicity this is usually carried out by making the total cross-sectional area Q3, Q4 of the metering openings associated with each sub-area F3, F4 proportional to these sub-areas. In the example of FIG. 1, for instance, an outlet pipe 22 with a cross-sectional area Q3 is associated with each outer sub-channel 15 with a sub-area F3 as a metering opening, while two outlet pipes 22 with a total cross-sectional area $Q4=2\times Q3$ are provided for each inner sub-channel 16 with a double area F4. This results in a total of 24 metering openings or outlet pipes 22 with a respective cross-sectional area Q3 for the inlet cross section $F=24\times F3$. The spacing P of two adjacent intersection points 17 in the main flow direction Z is shown in FIG. 1*b*. The length S of the mixing unit 4, which is kept as small as possible, corresponds, for example, to 1 to 2 times the spacing P. In this example S is approximately 1.3 times P, while in FIG. 4 the length S is equal to P. A good combined homogenization effect is thus achieved with a minimum pressure drop, particularly when the mixing unit 4 is followed by a free post-mixing section N (FIG. 8) which advantageously corresponds to 2 to 6 times the spacing P. In the example of FIG. 3 the same inlet cross section with the sub-channels F3, F4 is combined with another injection device. In this case three main metering pipes 20 extend transversely to the layers 11 with outlet pipes 22 and 23. Either two outlet pipes 22 with cross-sectional areas $\frac{1}{2}$ Q3 or one outlet pipe 23 with a cross-sectional area Q3 is/are associated with the outer sub-channels 15 with sub-areas F3. Either four outlet pipes 22 with an area $\frac{1}{2}$ Q3 or two outlet pipes 23 with areas Q3 are associated with the inner sub-channels 16 with sub-areas F4. The total of 24 outlet pipes 22 and the 12 outlet pipes 23 have a total cross-sectional area of all the metering openings of $24\times Q3$, which corresponds to the inlet cross section F of $24\times F3$.

In the example of FIG. 5 with a main pipe 20 extending transversely to the layer planes 12 the sub-areas F1 are defined by the 10 mixer layers 11: Therefore $F1=F/10$. The cross-sectional area of the top and the bottom outlet pipe 24 is twice that of the inner outlet pipes 23. Three metering pipes 23 with a cross-sectional area of $3\times\frac{1}{3}$ Q1= Q1 are in each case associated with the inner sub-areas F1, while one outlet pipe 23 with $\frac{1}{3}$ Q1 and one 24 with $\frac{2}{3}$ Q1 are in each case associated with the top and the bottom sub-area F1, again resulting in a total cross-sectional area Q1. In this case the total of 28 outlet pipes 23 and 24 have a total cross-sectional area of $10\times Q1$, corresponding to the total cross-sectional area $F=10\times F1$.

It is important for the metering openings 21 or the outlet pipes 22, 23, 24 always to be directed at the inside of sub-channels 15, 16 of the mixing unit 4 and not at channel walls 13 or intersection points 17.

As shown in FIG. 4, the directed metering openings 21, e.g. formed as bores in the main pipe 20, are of a length L which is at least half as great as their diameter D. The length L of the outlet pipes 22, 23, 24 is usually greater than D.

FIG. 6 shows a further example with a static mixing unit consisting of crossed rectangular plates or webs, which are connected together in the layer planes 12 at the intersection points 17. This forms intersecting, rectangular sub-channels 15 with cross-sectional areas F3, which are defined at the two closed sides by a channel wall 13 and at the two open sides 14 by the layer planes 12. The main channel cross section F is divided into 24 sub-areas F3, which are of the same size, of the sub-channels 15, a directed outlet pipe 22 with a cross-sectional area Q3 being associated with each sub-area F3.

Figure 7B:
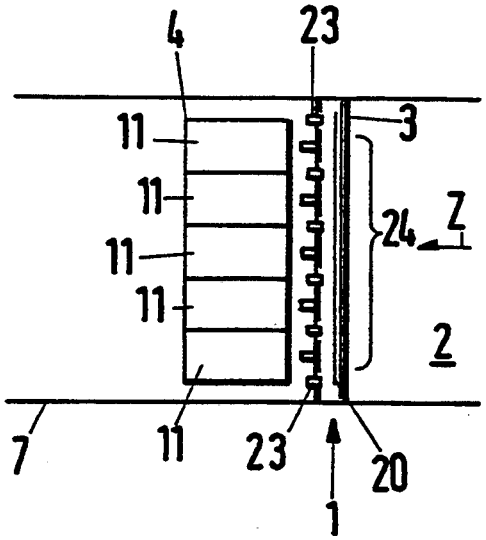
Figure 7C:
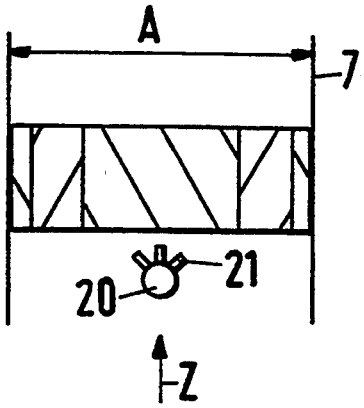

The main channel 7 in FIG. 7 has a circular cross section F. Five layers 11 divide this area F into approximately five sub-areas F2 of the same size. A total cross-sectional area Q2 of the outlet pipes is associated with each sub-area F2, three outlet pipes 24 with $\frac{1}{3}$ Q2 being associated with the three inner layers and sub-areas F2, and two outlet pipes 23 with 1/6 Q2 and one outlet pipe 24 with $\frac{1}{3}$ Q2 being associated with the two outer layers.

FIG. 8 shows a mixing device in the form of an arc in the main channel 7. The layer planes of the first mixing unit 4 extend in the direction of the arc so as to promptly compensate for inhomogeneity. This unit is followed by a free post-mixing section N, which is approximately twice as long as the mixing unit 4. The post-mixing section N is followed by a second mixing unit 5, the layers of which are directed perpendicularly to those of the mixing unit 4.

We claim:

1. A device for uniformly mixing a small quantity of a first fluid to be mixed into a main large flow of second fluid, the main large flow of second fluid flowing from upstream to downstream through a conduit parallel to an axis, the device for uniformly mixing located in said conduit and including an injection system for introducing the small quantity of said first fluid to be mixed and at least one static mixing unit for uniformly mixing the introduced small quantity of said first fluid and the main large flow of said second fluid, said static mixer arranged downstream from said injection system and occupying an inlet cross section across said conduit substantially normal to fluid flow in said conduit, said device for uniformly mixing comprising:

at least one static mixer in said conduit having a plurality of layers, each said layer of said static mixer defining a plurality of discrete channels disposed at an angle to the axis of flow of said main large flow of second fluid through said conduit, the discrete channels of one layer being disposed at intersecting angles with respect to the discrete channels of adjacent layers;

said plurality of layers of said discrete channels includes said discrete channels having channel side walls;

the side walls of the discrete channels of one layer intersect the side walls of the discrete channel of another layer at intersection points;

the length of the at least one static mixer being between one and two times as great as a spacing of two adjacent channel side wall intersection points parallel to the main flow direction;

the inlet cross section of the static mixing unit divided into sub-areas defined by the inlet to said discrete channels at said inlet cross section; and, the injection system comprises at least one main metering manifold for metering said small quantity of first fluid with a plurality of metering outlets which are directed at the sub-areas, the metering outlets communicated to said manifold and each having a length and a diameter directed to the sub-areas being dimensioned such that said metering outlets having a length of which is at least half as great as their diameter and said metering outlets further being dimensioned such that the volumetric flow of the first fluid passing through the metering outlets are proportional to the volumetric flow of the main large flow of second fluid through the corresponding sub-areas.

2. Mixing device according to claim 1 wherein:

discrete metering outlets are addressed to each discrete subarea; and, the cross-sectional area of the discrete metering outlets associated with each sub-area proportional to the total cross-sectional area of all metering outlets multiplied by a fraction having the area of the discrete sub-area as a numerator and the area of all inlet cross sections a denominator.

3. Mixing device according to claim 1 wherein:

the metering outlets which are directed consist of cylindrical bores in the wall of the metering manifold.

4. Mixing device according to claim 1 wherein:

the directed metering outlets are formed as outlet pipes.

5. Mixing device according to claim 1 and wherein:

the metering outlets are directed at the inside of discrete channels.

6. Mixing device according to claim 1 wherein:

the injection system includes one main metering manifold which extends perpendicularly to the layers of said static mixer.

7. Mixing device according to claim 1 wherein:

at least two main metering manifolds are provided.

8. Mixing device according to claim 1 and wherein:

the cross section area of each metering manifold is at least twice as great as the sum of the cross-sectional areas of all the metering outlets of each said metering manifold.

9. Mixing device according to claim 1 and wherein:

a total of between 20 to 100 metering outlets are provided.

10. Mixing device according to claim 1 and wherein:

the discrete channels of the mixing unit are disposed at an angle between 25° and 35° with respect to the main flow direction in the conduit.

11. Mixing device according to claim 1 and wherein:

said first static mixing unit is followed by a free post-mixing section in the main conduit which is between two and six times large as the spacing of two adjacent channel side wall intersection points parallel to the main flow direction;

said free post-mixing section following the first mixing unit is between one and three times as large as the main conduit at the first mixing unit.

12. Mixing device according to claim 13 wherein:

a second mixing unit is arranged downstream to the free post-mixing section in the main conduit.

13. Mixing device according to claim 1 wherein:

at least two mixing units whose discrete channels have different angularities with respect to the main flow are arranged in the main conduit.

14. A device for uniformly mixing a small quantity of a first fluid to be mixed into a main large flow of second fluid, the main large flow of second fluid flowing from upstream to downstream through a conduit parallel to an axis, the device for uniformly mixing located in said conduit and including an injection system for introducing the small quantity of said first fluid to be mixed and at a static mixing unit for uniformly mixing the introduced small quantity of said first fluid and the main large flow of said second fluid, said static mixer arranged downstream from said injection system and occupying an inlet cross section across said conduit substantially normal to fluid flow in said conduit, said device for uniformly mixing comprising:

first static mixer in said conduit having a plurality of layers, each said layer of said static mixer defining a plurality of discrete channels disposed at an angle to the axis of flow of said main large flow of second fluid through said conduit, the discrete channels of one layer being disposed at intersecting angles with respect to the discrete channels of adjacent layers;

said plurality of layers of said discrete channels includes said discrete channels having channel side walls;

the side walls of the discrete channels of one layer intersect the side walls of the discrete channel of another layer at intersection points;

second static mixing unit disposed in said conduit;

said first static mixing unit is followed by a free post-mixing section in the main conduit which is between two and six times large as the spacing of two adjacent channel side wall intersection points parallel to the main flow direction;

the length of the first static mixer is between one and two times as great as a spacing of two adjacent channel side wall intersection points parallel to the main flow direction;

the inlet cross section of the static mixing unit divided into sub-areas defined by the inlet to said discrete channels at said inlet cross section; and, the injection system comprises at least one main metering manifold for metering said small quantity of first fluid with a plurality of metering outlets which are directed at the sub-areas, the metering outlets communicated to said manifold and each having a length and a diameter directed to the sub-areas being dimensioned such that said metering outlets having a length of which is at least half as great as their diameter and metering outlets further being dimensioned such that the volumetric flow of the first fluid passing through the metering outlets are proportional to the volumetric flow of the main large flow of second fluid through the corresponding sub-areas.

* * * * *